US007491129B1

(12) United States Patent
Stanley

(10) Patent No.: US 7,491,129 B1
(45) Date of Patent: Feb. 17, 2009

(54) ADJUSTABLE POOL TABLE

(76) Inventor: Andrew Stanley, 569 Main St., Unit D-3, Hyannis, MA (US) 02601

( * ) Notice: Subject to any disclaimer, the term of this patent is extended or adjusted under 35 U.S.C. 154(b) by 132 days.

(21) Appl. No.: 11/501,277

(22) Filed: Aug. 9, 2006

(51) Int. Cl.
*A63D 13/00* (2006.01)
*A63D 15/00* (2006.01)

(52) U.S. Cl. ..... 473/16; 473/12; 473/17

(58) Field of Classification Search ..... 473/1, 473/4, 9, 10, 14, 15, 16, 496; 273/309, 108.33, 273/118 R, 126 R; 108/59, 65, 102, 103
See application file for complete search history.

(56) References Cited

U.S. PATENT DOCUMENTS

| | | | | |
|---|---|---|---|---|
| 296,677 | A | 4/1884 | Chasley | |
| 393,910 | A | 12/1888 | Kostner | |
| 662,948 | A | 12/1900 | Lawrence et al. | |
| 675,273 | A | 5/1901 | Fuller | |
| 810,224 | A | 1/1906 | Sackett | |
| 895,786 | A | 8/1908 | Perkins | |
| 1,512,442 | A | 10/1924 | Arnold | |
| 2,640,697 | A | 6/1953 | Elersich | |
| 2,808,223 | A | 10/1957 | Abeles et al. | |
| 3,001,791 | A * | 9/1961 | Atwood | 473/470 |
| 3,353,777 | A | 11/1967 | Knoedler | |
| 3,547,443 | A | 12/1970 | Lacson | |
| 3,801,097 | A | 4/1974 | Van Derhei | |
| 3,947,035 | A | 3/1976 | Bouchard | |
| 4,034,978 | A * | 7/1977 | Becker | 473/416 |
| 4,768,781 | A | 9/1988 | McMillin | |
| 5,131,664 | A | 7/1992 | Medina | |
| 5,655,979 | A * | 8/1997 | Blue | 473/475 |
| 7,220,185 | B2 * | 5/2007 | Chen | 473/4 |
| 7,264,551 | B2 * | 9/2007 | Ghahraman | 473/16 |
| 2006/0261765 | A1 * | 11/2006 | Prasanna | 318/254 |

* cited by examiner

*Primary Examiner*—Mitra Aryanpour
(74) *Attorney, Agent, or Firm*—John P. McGonagle

(57) ABSTRACT

A rotatable pool table with an electromagnetic pad imbedded in the pool table's surface. Each pool ball has a metallic element imbedded in its center. The electromagnetic pad is adapted to being activated, creating a magnetic field to hold the pool balls in position while the table is rotated. The pool table playing surface may be vertically raised and lowered.

2 Claims, 5 Drawing Sheets

ADJUSTABLE POOL TABLE

BACKGROUND OF THE INVENTION

This invention relates to pool tables, and in particular, to a rotatable and vertically adjustable pool table.

Due to a conventional pool table's size, a pool table is not readily available for use in a player's home, i.e., basement or recreation room. Rotary pool tables are known in the prior art. The advantage of a rotary pool table is that it may be positioned near a wall which would otherwise prevent a player from using a conventional-length cue stick, or prevent the player from positioning his body between the table and the wall. The rotary feature allows a full size pool table to be used in a player's own home which would not normally have the room for a conventional pool table. The basic disadvantage of a rotary pool table is the disturbance of the pool balls as the table is rotated.

SUMMARY OF THE INVENTION

The present invention addresses the above problem by providing a rotatable table with an electromagnetic pad imbedded in the pool table's surface. Each pool ball has a metallic element imbedded in its center. When the electromagnetic pad is activated, a magnetic field is created and the pool balls are held in their existing position on the table's surface while the table is rotated. After the table is rotated and locked into a desired position, the electromagnetic pad is deactivated, and the pool balls are free to being moved about in the normal course of a pool game. The present invention pool table also has the ability to vertically lift and lower the playing surface to provide accessibility for younger children, the elderly and handicapped players.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be made to the accompanying drawings and descriptive matter in which there is illustrated a preferred embodiment of the invention.

DETAILED DESCRIPTION OF THE INVENTION

Figure 1:
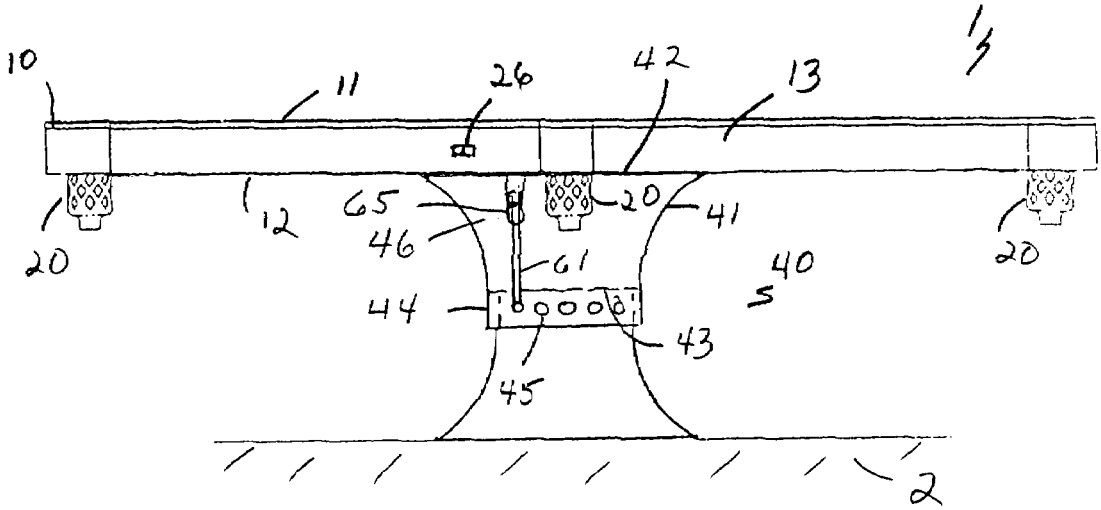
FIG. 1 is a side view of an adjustable pool table.
Figure 2:
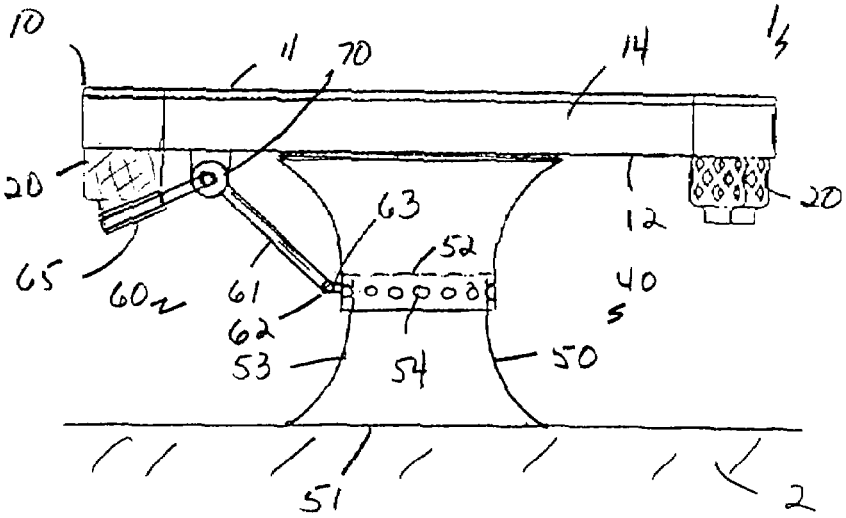
FIG. 2 is an end view of the table of FIG. 1.
Figure 3:
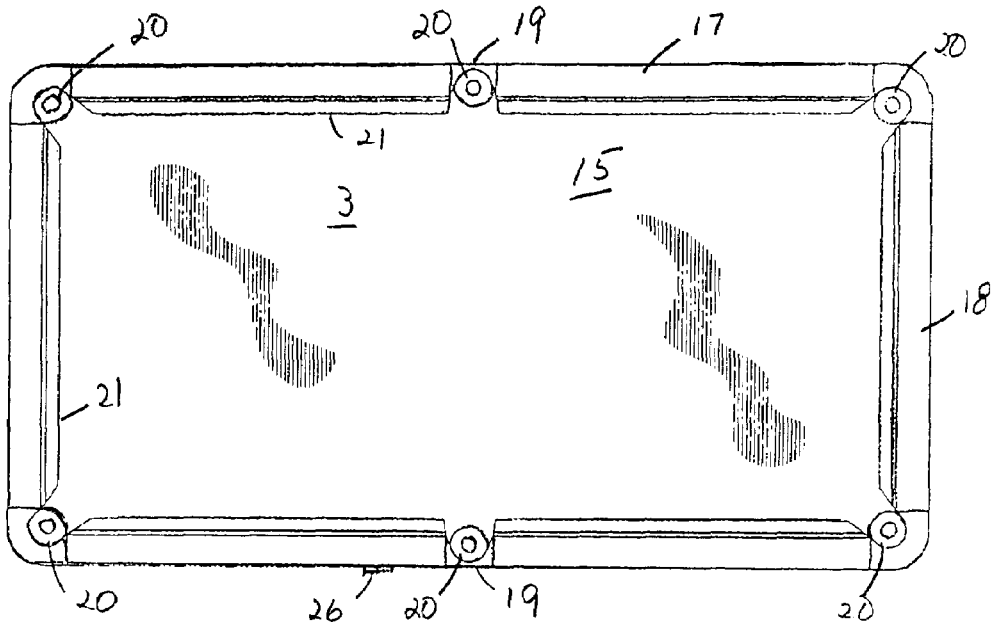
FIG. 3 is a top view of the table of FIG. 1.
Figure 4:
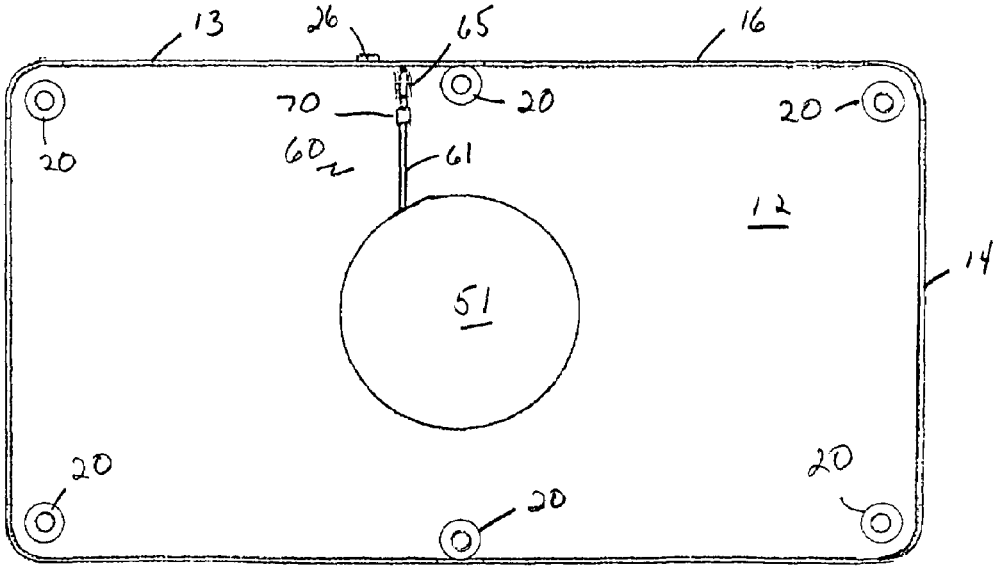
FIG. 4 is a bottom view of the table of FIG. 1.
Figure 5:
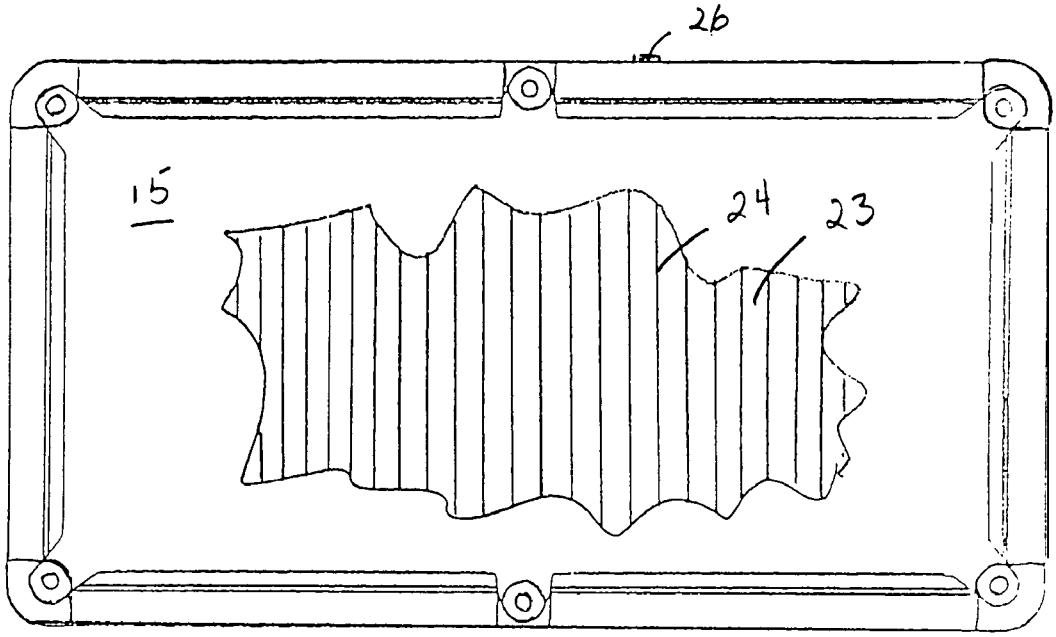
FIG. 5 is a top view of the table of FIG. 1 with the playing surface partially removed.
Figure 7:
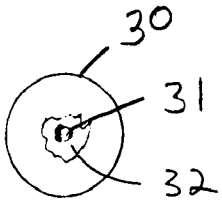
FIG. 7 is a view of an invention pool ball with center partially opened.
Figure 6:
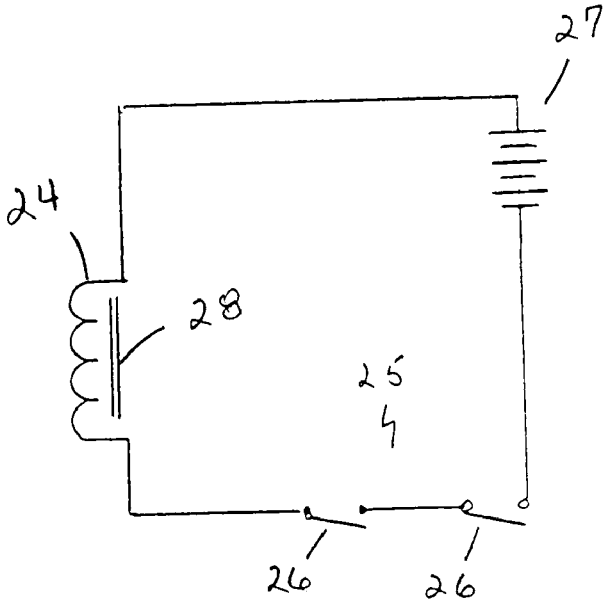
FIG. 6 is a circuit diagram of the invention electromagnetic pad and switch assembly.
Figure 8:
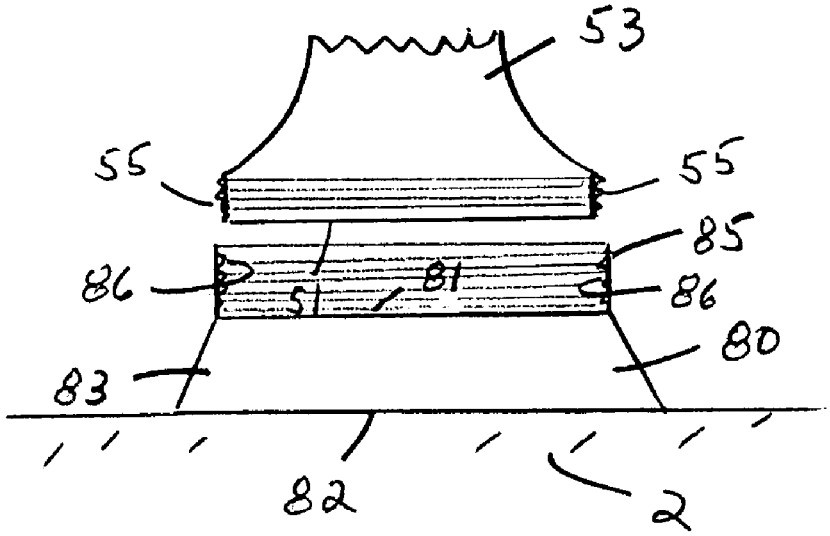
FIG. 8 is a cross sectional view showing means for raising and lowering the pool table.
Figure 9:
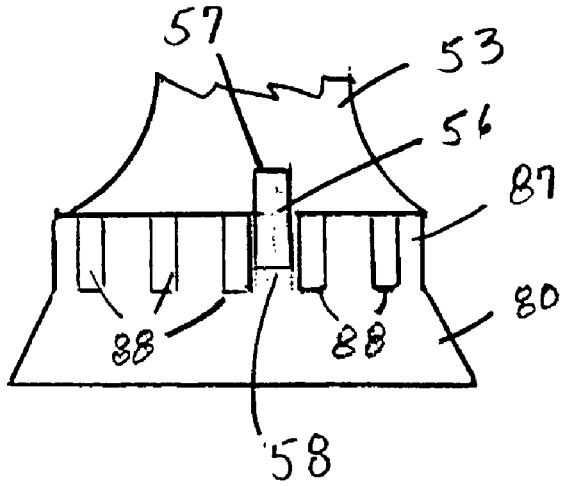
FIG. 9 is a view of the locking element engaging the floor base.
Figure 10:
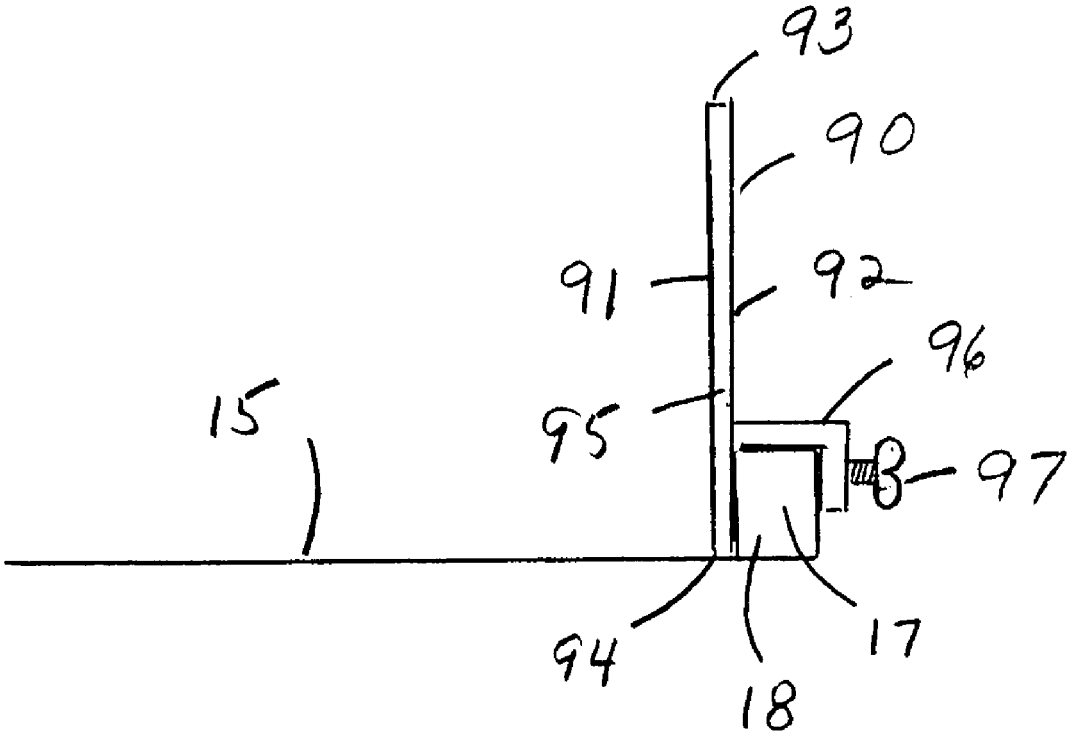
FIG. 10 is a side view of a playing board.

Referring to the drawings in detail wherein like elements are indicated by like numerals, there is shown an adjustable pool table 1 constructed according to the principles of the present invention. The adjustable pool table 1 is comprised of a table top assembly 10 joined to a table base assembly 40.

The table top assembly 10 has a top 11, bottom 12, two parallel long sides 13 and two parallel short sides 14, said short sides being perpendicular to said long sides. The top 11 has a generally rectangular, flat, playing surface 15 surrounded along its perimeter 16 by two long, opposite side rails 17 and two, short, opposite side rails 18, said short side rails being perpendicular to said long side rails. The top 11 has six pockets 20 formed therein, one at the junction of each short and long side rail and one at the midpoint 19 of each long side rail. The side rails 17, 18 are generally comprised of a cushioning material and an elongated hard, strip 21 of resilient material along that portion of the rail facing the playing surface 15. The playing surface 15 is generally covered with a wool fabric 3 such as felt.

An electromagnetic pad 23 is attached to the playing surface undersurface, said electromagnetic pad 23 being comprised of ferromagnetic material 28 with insulated wire 24 wound round it. The wire 24 terminates in a switch assembly 25 joined to a power source 27. The switch assembly 25 has one or more switches 26 mounted on the table top sides 13, 14, said switches 26 adapted to operate the switch assembly 25. The switch assembly 25 operates to connect and disconnect the wire 24 to the power source 27. When the wire 24 is connected to the power source 27, the electromagnetic pad 23 is energized and a magnetic field is formed across the playing surface 15.

The pool balls 30 used in conjunction with the invention pool table 1 are of conventional construction with a metallic element 31 imbedded in each ball's center 32. When the electromagnetic pad 23 is energized, the magnetic field created holds each pool ball in position on the playing surface 15. When the switch assembly 25 is operated to disconnect the wire 24 from the power source 27, the electromagnetic pad 23 is de-energized, and the magnetic field collapses releasing the pool balls to be moved about in the normal course of a pool game.

The table base assembly 40 is fixedly joined to the table top assembly bottom 12. In this embodiment of the invention, the table base assembly 40 is comprised of a central pedestal with an upper portion 41 rotatably joined to a lower portion 50. The pedestal upper portion 41 has a frustrum-shaped body 46 with a flat top surface 42 centrally and fixedly joined to the table top assembly bottom 12. The pedestal upper portion body 46 has a round bottom surface 43 having a smaller diameter than the diameter of the pedestal upper portion top surface 42. The pedestal upper portion bottom surface 43 has a downwardly extending perimeter flange 44 having a plurality of open apertures 45 formed therein.

The pedestal lower portion 50 has a frustrum-shaped body 53 with a round bottom surface 51 resting on a floor 2 or equivalent support surface. The pedestal lower portion body 53 has a round top surface 52 having a diameter less than the diameter of the pedestal lower portion bottom surface 51, and less than the pedestal upper portion bottom surface 43, and less than an inner diameter of the perimeter flange 44. The pedestal lower portion body 53 has a plurality of apertures 54 formed therein adjacent the pedestal lower portion body top surface 52, said apertures corresponding to the perimeter flange open apertures 45. The upper pedestal body bottom surface 43 and lower pedestal body top surface 52 may optionally terminate in a plastic sliding piece or ball-bearing plate to ease the ability of the pedestal upper body 46 to rotate on the pedestal lower body 53.

The adjustable pool table 1 is further comprised of a lever assembly 60 attached to the table top assembly bottom 12.

The lever assembly 60 is comprised of an elongated control section 61 and an elongated hand section 65 pivotally joined to a bracket 70 attached to the table top assembly bottom 12. The control section 61 has a distal end 62 extending toward the lower pedestal portion 50, said distal end 62 terminating in a protruding element 63 adapted to fit into an upper pedestal flange open aperture 45 and corresponding lower pedestal body aperture 54. The hand section 65 extends away from the table base assembly 40 and is adapted to be grasped and manipulated by a player (not shown). An upward pressure on the hand section 65 will transfer an action through the bracket 70 pivoting the control section distal end 62 away from the table base assembly 40 thereby removing the protruding element 63 from the apertures 45, 54. The upper pedestal portion 41 may then be rotated about the lower pedestal portion 50 to any desired position. When a desired position is attained, a downward pressure is exerted on the hand section 65 pivoting the control section distal end 62 toward the table base assembly 40 thereby causing the protruding element 63 to be inserted into the apertures 45, 54 immediately in front of the element 63 thereby locking the table in place.

In operation, the adjustable pool table 1 appears to be a conventional pool table and the game of pool is played on it in a conventional manner. When the player(s) desire to rotate the table, a switch 26 is activated energizing the electromagnetic pad 23 and magnetically holding all of the pool balls 30 on the playing surface 15 in place. The lever assembly 60 is then operated as described above allowing the table base assembly upper pedestal portion 41 and attached table top assembly 10 to be rotated and locked into a desired position. By means of the switch 26, the electromagnetic pad 23 is deactivated, freeing the pool balls 30. The pool game may then be resumed.

In another embodiment of the invention, means are provided for raising and lowering the overall height of the pool table 1. In this example, the lower pedestal body 53 has a threaded portion 55 adjacent the lower pedestal portion bottom 51. The table base assembly 40 is further comprised of a floor base 80, having a top 81, a bottom 82, and a body 83 extending from said bottom 82 to said top 81. The floor base bottom 82 rests on a floor 2 or equivalent support surface. The floor base top 81 terminates in an upwardly extending circular flange 85 having a threaded interior 86. The floor base flange 85 has an inner diameter greater than the exterior diameter of the lower pedestal threaded body portion 55. The lower pedestal body threaded portion 55 threadingly engages the flange threaded interior 86. Rotation of the lower pedestal portion 50 thereby raises and lowers the over height of the pool table 1. The floor base flange 85 has an exterior 87 with a plurality of vertical rectangular spaced protrusions 88 formed thereon. The lower pedestal portion body 53 has an elongated rectangular locking element 56 having an upper end 57 and a lower end 58. The locking element upper end 57 is vertically and pivotally attached to the lower pedestal portion body 53. The locking element lower end 58 is adapted to fit between two of the plurality of floor base flange exterior surface protrusions 88. The locking element 56 prevents movement of the lower pedestal portion 50 relative to the floor base 80 while the locking element lower end 58 engages the floor base flange exterior protrusions 88.

In another embodiment of the invention, the pool table 1 includes a flat rectangular playing board 90 adapted to being removably fitted over one of the side rails 17, 18 forming an upright, vertical surface perpendicular to the table top playing surface 15. The playing board 90 provides means for playing a game of dice on said playing surface 15. The playing board 90 has a front 91, a rear 92, a top 93, a bottom 94 and two opposite sides 95. The playing board rear 92 has a clamp 96 attached thereto. The clamp 96 fits over a side rail 17 or 18, and is fixed to the side rail by means of a thumb screw 97.

It is understood that the above-described embodiment is merely illustrative of the application. Other embodiments may be readily devised by those skilled in the art which will embody the principles of the invention and fall within the spirit and scope thereof.

I claim:

1. An adjustable pool table, comprising:

a rotatable table with an electromagnetic pad imbedded in a table undersurface supporting a generally rectangular, flat playing surface, said electromagnetic pad being comprised of a generally flat ferromagnetic body having an insulated wire wound round it, said wire terminating in a switch assembly joined to a power source, said switch assembly adapted to connect and disconnect said wire to the power source, said switch assembly having a plurality of switches mounted on the table top assembly sides, said switches adapted to operate the switch assembly, said rotatable table comprising:

a table base assembly comprised of a central pedestal having:

an upper portion having a frustrum-shaped body with a flat top surface centrally and fixedly joined to the table top assembly bottom, said pedestal upper portion body having a flat bottom surface with a diameter smaller than a pedestal upper portion top surface diameter, said pedestal upper portion bottom surface has a downwardly extending perimeter flange with a plurality of open apertures formed therein;

a lower portion rotatable joined to said upper portion and having a frustrum-shaped body with a flat bottom surface resting on a support surface, said pedestal lower portion body having a flat top surface with a diameter less than a pedestal lower portion bottom surface, and a diameter less than the pedestal upper portion bottom surface diameter, and a diameter less than an perimeter flange inner diameter, said pedestal lower portion body having a plurality of apertures formed therein adjacent the pedestal lower portion body top surface, said apertures corresponding to the perimeter flange open apertures;

a lever assembly attached to the table top assembly bottom, said lever assembly comprising an elongated control section and an elongated hand section pivotally joined to a bracket attached to the table top assembly bottom, said control section having a distal end extending toward the lower pedestal portion, said distal end terminating in a protruding element adapted to fit into an upper pedestal flange open aperture and corresponding lower pedestal body aperture, said hand section extending away from the table base assembly and adapted to being grasped and manipulated by a player, wherein an upward pressure on the hand section will transfer an action through the bracket pivoting the control section distal end away from the table base assembly thereby removing the protruding element from an upper pedestal flange open aperture and corresponding lower pedestal body aperture, wherein said upper pedestal portion is adapted to being rotated about the lower pedestal portion when the protruding element is removed from said apertures, wherein a downward pressure exerted on the hand section pivots the control section distal end toward the table base assembly thereby inserting the protruding element into an upper pedestal flange open aperture and corresponding lower pedestal body aperture;

a sliding means joining said upper pedestal body bottom surface and lower pedestal body top surface selected from the group consisting of plastic sliding piece and ball-bearing plate;

a threaded portion on said lower pedestal body adjacent the lower pedestal portion bottom;

a floor base having a top, a bottom, and a body extending from said bottom to said top, said floor base top terminating in an upwardly extending circular flange having a threaded interior, said floor base flange having an inner diameter greater than an exterior diameter of the lower pedestal threaded body portion, said lower pedestal body threaded portion adapted to threadingly engage the flange threaded interior; and a table top assembly joined to the table base assembly, said table top assembly having a top, a bottom, two parallel long sides and two parallel short sides, said short sides being perpendicular to said long sides, said top having said playing surface surrounded about a playing surface perimeter by two long, opposite side rails and two, short, opposite side rails, said short side rails being perpendicular to said long side rails;

a plurality of pockets in said table top assembly top, one at the junction of each short and lone side rail and one at the midpoint of each long side rail, said side rails being comprised of a cushioning material and an elongated hard, strip of resilient material along that portion of each rail facing the playing surface;

a wool fabric covering on said playing surface;

a plurality of pool balls, each pool ball having a metallic element imbedded in its center.

2. An adjustable pool table as recited in claim 1, further comprising:

a plurality of vertical, rectangular, spaced protrusions formed on a floor base flange exterior;

an elongated rectangular locking element having an upper end and a lower end, said locking element upper end being vertically and pivotally attached to the lower pedestal portion body, said locking element lower end adapted to fit between two of the plurality of floor base flange exterior surface protrusions.

* * * * *